United States Patent [19]

Cheetham

[11] 4,169,430

[45] Oct. 2, 1979

[54] MODULAR HEAT EXCHANGERS WITH A COMMON FLUE

[76] Inventor: Harry A. Cheetham, 7 Water Tower Rd., Broadstone, Dorset, England

[21] Appl. No.: 821,579

[22] Filed: Aug. 3, 1977

[30] Foreign Application Priority Data

Aug. 12, 1976 [GB] United Kingdom ..... 33535/76

[51] Int. Cl.[2] ..... F22B 31/04

[52] U.S. Cl. ..... 122/25; 122/240 R; 122/367 C

[58] Field of Search ..... 122/25, 235 MF, 240 R, 122/240 B, 367 R, 367 C

[56] References Cited

U.S. PATENT DOCUMENTS

| | | | |
|---|---|---|---|
| 862,218 | 8/1907 | Turansky | 122/25 |
| 1,054,944 | 3/1913 | Schneider | 122/25 |
| 3,043,279 | 7/1962 | Blomquist | 122/240 |
| 3,302,705 | 2/1967 | Witten, Jr. | 122/367 |
| 3,692,104 | 9/1972 | Gerstmann | 122/367 |
| 3,701,340 | 10/1972 | Miller | 122/367 |
| 4,055,152 | 10/1977 | Vidalenq | 122/367 |

*Primary Examiner*—Kenneth W. Sprague
*Attorney, Agent, or Firm*—Pearne, Gordon, Sessions, McCoy & Granger

[57] ABSTRACT

A heat exchanger system for preferably heating water in a space heating system, in which a plurality of heat exchanger units are connected in parallel between inflow and outflow conduits for the fluid to be heated, said heat exchanger units being housed in a common duct constituting a flue for gaseous products of combustion from said units.

11 Claims, 7 Drawing Figures

MODULAR HEAT EXCHANGERS WITH A COMMON FLUE

BACKGROUND OF THE INVENTION

This invention relates to a heat exchanger system and particularly, but not exclusively, to a water heating system.

It is difficult to maintain the overall efficiency of a central heating system because of the large variation in demand on the system caused by wide variation of temperature externally of the building being heated and this means that the heating plant must be capable of a very large turndown range. Known boilers which are currently in use all have the disadvantage of a reduction in thermal efficiency as turndown is increased. One method of overcoming this problem is to use a system in which a plurality of boilers are connected in parallel between inflow and outflow conduits, each boiler being connected to a separate flue which leads to a common main flue. The total output of the boilers is sufficient to cater for the maximum demand, and as the demand falls the number of boilers in operation is reduced in order to maintain the desired water temperature. Even with this system the efficiency of the system as a whole is reduced as the number of operating boilers is reduced. The reason for this is that the radiation losses from the boilers remain constant and natural draught draws cold air through the boilers which are not in operation. This has the effect of cooling down the water flowing through the inoperative boilers. Another disadvantage of this known system is that each boiler needs a separate flue and this is expensive and difficult to install.

SUMMARY OF THE INVENTION

This invention relates to a heat exchanger system and particularly, but not exclusively, to a water heating system for radiators of a space heating system.

An object of the present invention is to provide a heat exchanger system which is efficient and in which the efficiency is not reduced as the number of boilers in operation is reduced.

According to the present invention there is provided a heat exchanger system comprising a plurality of heat exchanger units connected in parallel between inflow and outflow conduits for the fluid to be heated and said units being housed in a common duct constituting a flue for gaseous products of combustion from said units.

The duct is preferably arranged to be vertical and said heat exchanger units are disposed one above another.

Preferably each heat exchanger unit comprises a water heater. Each heat exchanger unit is preferably gas fired.

With the heat exchanger system according to the present invention the exhaust gas from each heat exchanger is not discharged separately but goes into the common flue so that inoperative units receive heat from the exhaust gas of the operative units. The heat exchangers are preferably modular units arranged in the comon duct which acts as a flue.

BRIEF DESCRIPTION OF THE DRAWINGS

To the accomplishment of the foregoing and related ends, the invention then comprises the features hereafter fully described and particularly pointed out in the claims, the following description and annexed drawings setting forth in detail certain illustrative embodiments of the invention, these being indicative however of only some ways in which the principle of the invention may be employed.

In said annexed drawings.

DESCRIPTION OF THE PREFERRED EMBODIMENTS

Figure 1:
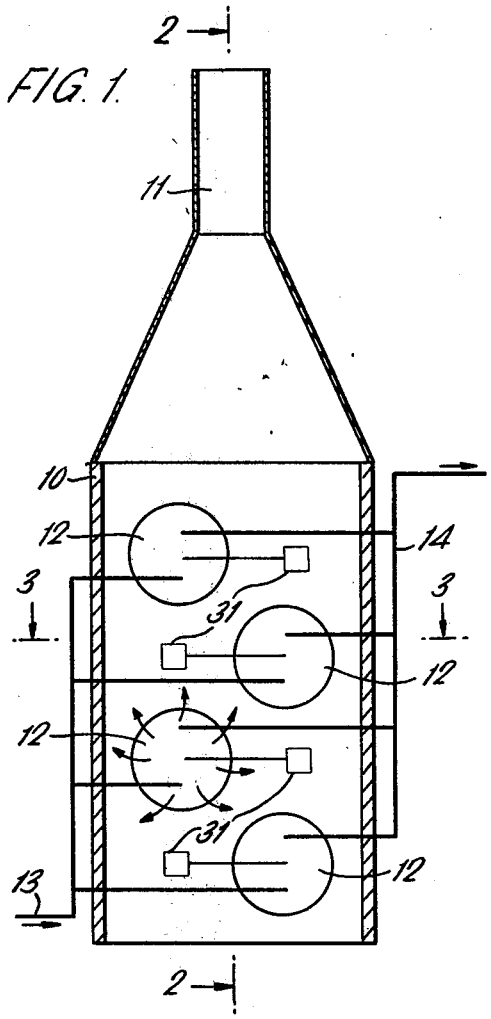
FIG. 1 is a longitudinal section through a duct forming a flue housing a plurality of heat exchangers according to the present invention.
Figure 2:
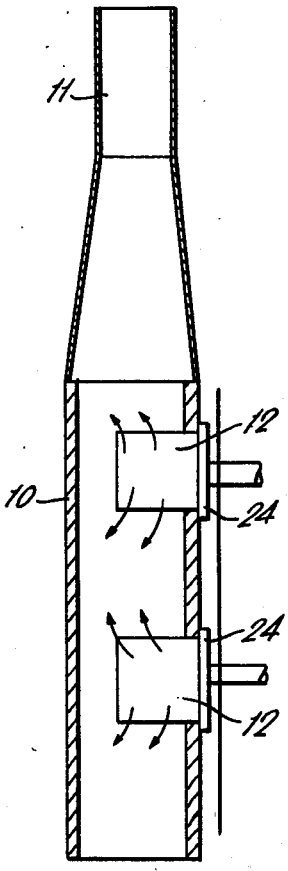
FIG. 2 is a section taken along the line 2—2 of FIG. 1.
Figure 3:
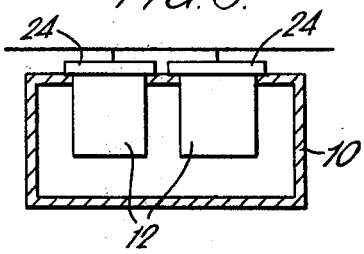
FIG. 3 is a transverse section taken along the line 3—3 of FIG. 1.

The heat exchanger system shown in FIGS. 1 to 3 consist of a duct 10 forming a flue which at its upper end is connected to a chimney 11. Preferably the walls of the duct 10 are thermally insulated. Mounted on one or more walls of the duct 10 and housed within the duct 10 are a plurality of heat exchanger units 12, in this case four units 12. The heat exchanger units 12 are connected in parallel between an inflow conduit 13 and an outflow conduit 14. Liquid, such as water, can be circulated through the conduits 13, 14 and heat exchange units 12 by a pump, not shown.

Figure 4:
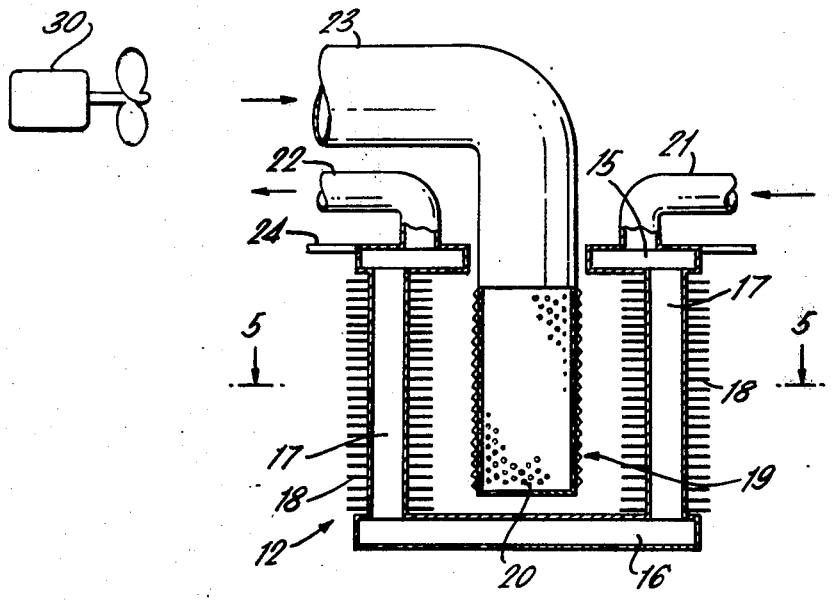
FIG. 4 is a diagrammatic plan view of a suitable heat exchanger.
Figure 5:
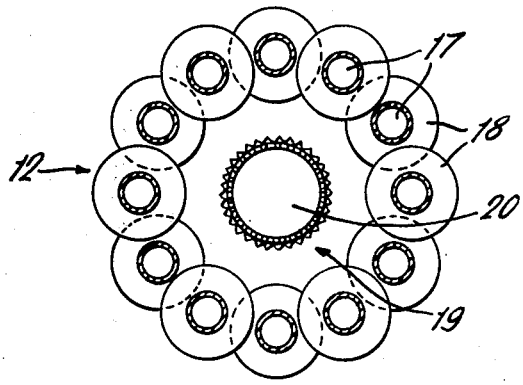
FIG. 5 is a section taken along the line 5—5 of FIG. 4.

Each heat exchange unit 12 can be as shown in FIGS. 4 and 5 and comprise two spaced apart headers 15 and 16 which are interconnected by a plurality of tubes 17 each provided with an extended surface 18 in the form of a helical fin or plurality of fins. The tubes 17 are arranged in an annular array to form a combustion zone 19 in which is located a burner 20. The headers 15 and 16 are divided into compartments so that water in flowing from an inlet 21 to an outlet 22 has to make a plurality of passes through the tubes 17. The burner 20 receives a gaseous fuel/air mixture through a conduit 23 and this is supplied by a fan 30. Such a heat exchanger unit forms the subject of my copending United Kingdom Patent application No. 4492/77. Alternatively the heat exchanger units 12 can be oil fired units.

The burner 20 of each unit 12 and the burner control system may be as described in my copending United Kingdom Patent Application No.

Figure 6:
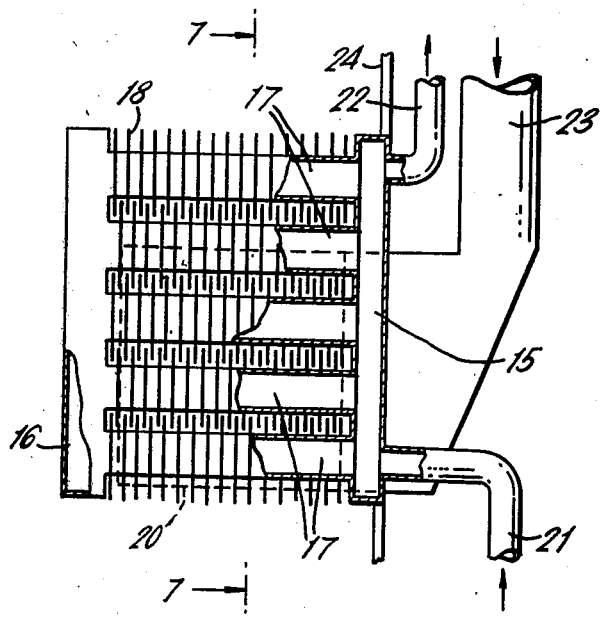
FIG. 6 is a diagrammatic side elevation of another embodiment of heat exchanger.
Figure 7:
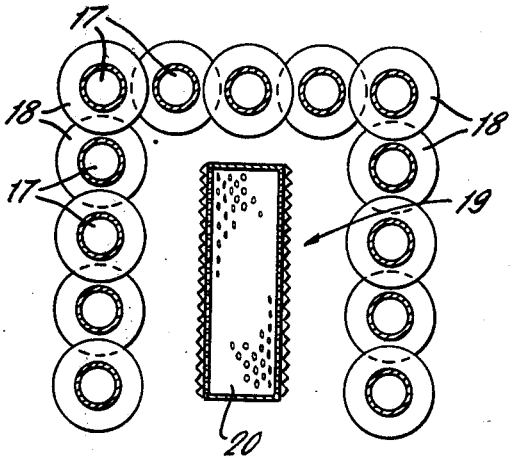
FIG. 7 is a section taken along the line 7—7 of FIG. 6.

FIGS. 6 and 7 show a heat exchange unit 12 which is similar to that shown in FIGS. 4 and 5 but in which the tubes 17 are arranged on three sides of a rectangle and the burner 20 is vertical. The heat exchange units 12 are each provided with a flange 24 through which the unit is secured to the wall of the duct 10.

The heat exchange units 12 are modular units and can be of any convenient size and shape. The units shown in FIGS. 4 to 7 are examples only and any other type of heat exchanger unit may be used. Water or any other suitable fluid passes through the units 12 and is heated by the hot gases. The burners 20 may be of the premixed type or partially premixed type or a wholly diffusion flame type.

Each unit 12 will have an ignition system and a means for sensing that combustion is established at the burner.

A thermostat 31 can be provided in each heat exchanger unit to detect water temperature and be capable of turning off the fuel and air supply to the associated burner 20.

In use of the system the fluid to be heated will flow through each unit 12. The products of combustion after passing over the tubes 17 of the individual units 12 is discharged into the duct 10. At full demand conditions all of the units 12 will be in operation, and as the demand is reduced the number of units 12 in operation will be reduced. This can be achieved by any suitable control system which reduces the number of operative units 12 sequentially dependent upon the demand or by adjusting the thermostats of the individual units to ensure that sequential switching off occurs.

A preferred method of operation is to turn-off the burners 20 of the units 12 in such a way that the highest burner is turned off first and sequentially to the lowest burner. In this manner of operation the combustion gases from the operative units 12 will add a little heat to the water flowing through the inoperative units 12 and consequently the overall efficiency of the system is not reduced by a reduction in load, but is increased.

Each unit 12 is arranged for easy removal from the duct 10 and a blank cover plate can be put in its place so that maintenance work on any unit 12 can be easily carried out without having to put the whole system out of operation.

The duct 10 may be horizontal and provided with a forced draught, in which case the burners 20 of the units 12 will be turned off sequentially starting with the downstream unit 12.

I, therefore particularly point out and distinctly claim as my invention:

1. A heat exchanger system comprising a plurality of separate individual modular heat exchanger units each having an inlet for fluid to be heated, an outlet for fluid heated in the unit and a burner, said units being connected in parallel between an inflow conduit connected to each inlet and an outflow conduit connected to each outlet, said heat exchanger units being housed in a common duct constituting a flue for gaseous products of combustion from said units.

2. A heat exchanger system as claimed in claim 1, wherein the duct is vertical and said units are disposed one above another.

3. A heat exchanger system as claimed in claim 1, wherein each unit is carried by and extends from a wall of the duct.

4. A heat exchanger system as claimed in claim 1, wherein the duct is thermally insulated.

5. A heat exchanger system as claimed in claim 1, wherein each heat exchanger unit comprises a water heater.

6. A heat exchanger system as claimed in claim 1, wherein each heat exchanger unit is gas fired.

7. A heat exchanger system as claimed in claim 1, wherein each heat exchanger unit consists of two spaced apart headers, one header having said inlet and the other having said outlet, said two headers being interconnected by tubes provided with extended surfaces, said tubes defining a combustion space and a burner located in said combustion space.

8. A heat exchanger system as claimed in claim 1, wherein each heat exchanger unit consists of two spaced apart headers, one header having said inlet and the other having said outlet, said two headers being interconnected by tubes provided with extended surfaces, said tubes defining a combustion space and a burner located in said combustion space, said tubes being arranged in an annular array to define a substantially circular combustion space and said burner being located on the axis of said combustion space and extending axially.

9. A heat exchanger system as claimed in claim 1 wherein each heat exchanger unit consists of two spaced apart headers, one header having said inlet and the other having said outlet, said two headers being interconnected by tubes provided with extended surfaces, said tubes defining a combustion space and a burner located in said combustion space, and including a fan for supplying a gaseous fuel/air mixture to the burner.

10. A heat exchanger system as claimed in claim 1, wherein said duct is connected to a chimney.

11. A heat exchanger system as claimed in claim 1, including a control system for turning off the units sequentially in dependence upon a decrease in demand.

* * * * *